United States Patent [19]

Bourgois

[11] Patent Number: 4,969,497

[45] Date of Patent: Nov. 13, 1990

[54] STRAND FOR REINFORCING OBJECTS MADE OF POLYMER MATERIAL

[75] Inventor: Luc Bourgois, Desselgem, Belgium

[73] Assignee: N.V. Bekaert S.A., Zwevegem, Belgium

[21] Appl. No.: 284,842

[22] Filed: Dec. 13, 1988

Related U.S. Application Data

[62] Division of Ser. No. 48,619, May 11, 1987, Pat. No. 4,818,631.

[30] Foreign Application Priority Data

Jun. 19, 1986 [NL] Netherlands ..... 8601599

[51] Int. Cl.[5] ..... B60C 9/00

[52] U.S. Cl. ..... 152/451; 57/902; 152/527; 152/556; 428/295; 428/377

[58] Field of Search ..... 152/451, 527, 548, 556; 428/295, 605, 377, 379; 57/210, 212, 902

[56] References Cited

U.S. PATENT DOCUMENTS

| | | | |
|---|---|---|---|
| 4,176,705 | 12/1979 | Russell et al. | 57/220 |
| 4,258,543 | 3/1981 | Canevari et al. | 57/902 |
| 4,268,573 | 5/1981 | Baillievier | 57/902 |
| 4,328,852 | 5/1982 | Poque et al. | 57/902 |

FOREIGN PATENT DOCUMENTS

| | | | |
|---|---|---|---|
| 834259 | 4/1976 | Belgium . | |
| 861243 | 5/1978 | Belgium . | |
| 0144811 | 6/1985 | European Pat. Off. . | |
| 2648524 | 5/1978 | Fed. Rep. of Germany . | |
| 2476548 | 2/1981 | France . | |
| 60-38208 | 2/1985 | Japan | 152/451 |
| 60-246886 | 12/1985 | Japan | 57/212 |
| 0652585 | 4/1951 | United Kingdom | 57/902 |

OTHER PUBLICATIONS

Research Disclosure, No. 184, Aug. 1979, blz. 430–431, No. 18441, Industrial Opportunities Ltd., Homewell Havant, Hampshire, GB; "Rubber Articles Reinforced With High Tensile Steel Cord".

*Primary Examiner*—John J. Gallagher
*Assistant Examiner*—Geoffrey L. Knable
*Attorney, Agent, or Firm*—Foley & Lardner, Schwartz, Jeffery, Schwaab, Mack, Blumenthal & Evans

[57] ABSTRACT

Strand for application as reinforcement in objects of polymer material comprising at least one core and less than six outside wires arranged round it, the core having an outside diameter larger than the diameter of the circle tangent to each of the outside wires in the hollow space that remains free when their cross-sections have the highest packing density and smaller than the diameter of the outside wires, whereby the outside wires are made of carbon steel wire with a tensile strength of at least 2250–1130 log d N/mm$^2$, d being the wire diameter in mm.

13 Claims, 2 Drawing Sheets

STRAND FOR REINFORCING OBJECTS MADE OF POLYMER MATERIAL

Figure 1A:
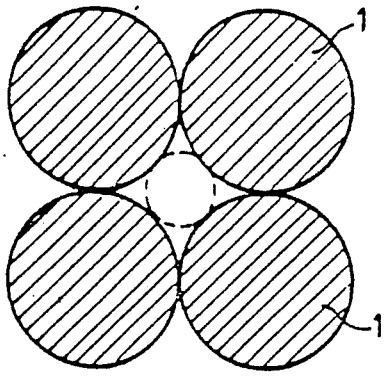

This application is a division, of application Ser. No. 048,619, filed May 11, 1987 now U.S. Pat. No. 4,818,631.

The invention relates to a strand for application as reinforcement in objects of polymer material comprising a core wire and outside wires arranged round it, the core having and outside diameter that is larger than the diameter of the circle tangent to each of the outside wires in the hollow space that remains free when their cross-sections have the highest packing density and that is smaller than the diameter of the outside wires.

Such strand is known from Belgian Patent No. 834,259 of the present applicant wherein a strand for the reinforcement or strengthening of polymer material is described. Such strand consists of a core and outside wires arranged round it, the core being given such an outside diameter that between the outside wires gaps are created whereinto polymer material can penetrate during the embedding process, thereby greatly enhancing the bond between the strand material and the polymer material. The core can consist of one core wire or of one core strand, which is then formed from several core wires.

The term of "highest packing density" stated hereinbefore is in this case to be understood as referring to a two-dimensional configuration of cross-sections of the outside wires, such that each separate outside wire is in contact with two adjacent outside wires, the centres of all adjacent cross-sections lying on the circumference of a circle. The inside tangent-circle diameter of the hollow space thus enclosed by the stacked cross-sections which serves as minimum diameter for the outside diameter of the core to be used can be determined easily.

Such strands are widely applied in all kinds of objects of polymer material such as synthetic conveyor belts and rubber vehicle tires.

The strands according to Belgian Patent No. 834,259 applied heretofore have the disadvantage that, with minimal diameters of core wire and outside wires as regards strand strength, the polymer penetration is often still insufficient. To enhance this penetration, either the diameter of the outside wires should be reduced or the diameter of the core wire enlarged. Both solutions are, however, unattractive from which follows that the strength of the strand and the extent of polymer penetration are conflicting properties.

The present invention is intended to provide a solution to the disadvantage discussed hereinabove and relates for that purpose to a strand as described hereinbefore characterised in that the outside wires are made of carbon steel wire with a tensile strength of at least 2250–1130 log d N/mm$^2$, d being the wire diameter in mm.

The outside wires are preferably made of carbon steel wire with a tensile strength of at least 2325–1130 log d N/mm$^2$, d being the wire diameter in mm.

For an explanation of the tensile-strength formula stated hereinbefore, the reader is referred to European Patent Application No. 0 144 811 of the present application, wherein a description is given of carbon steel wire with high tensile strength meeting such requirements.

The application of aforementioned carbon steel wire with high tensile strength has the advantage that outside wires of a smaller diameter than usual heretofore will suffice for an equal tensile strength of the total strand, which results in a considerable increase in rubber penetration, the total tensile strength being equal. Further, as a result of the possibility to use outside wires of a smaller diameter, the total diameter of the strands is reduced, which, compared to the strands used heretofore, has the advantage of an enhanced rubber penetration on the one hand and on the other hand the advantage of a reduced total diameter which shows itself in a decrease in the thickness of the polymeric objects whereinto such strands are incorporated.

The high tensile wire used for the strands described hereinbefore can be obtained in various ways.

This wire can for instance be obtained departing from carbon steel wire with high carbon content subject to the observation of special precautions, such as a choice of wire rods with few impurities (inclusion, residual and/or scrap elements) and refined manufacturing methods, for instance wire drawing with small subreductions (increase in the number of drawing passes). However, this does not always offer high tensile wire that can be successfully processed into strands during bunching or cabling. This wire can also be obtained departing from high carbon steel wire with the usual silicon and maganese contents, if only a sulphur contents of not more than 0.015 per cent by weight is allowed, and preferably a sulphur content that is lower than 0.0010 per cent by weight, as described in aforementioned European Patent Application No. 0 144 811.

Preferably, the core of the strand according to the invention is one core wire. The core can also consist of one core strand, which is then composed of several core wires, for instance obtained by bunching or cabling in the usual way.

With particular advantage, the core wires constituting the core receive a regular undulatory deformation in longitudinal direction. Such undulatory deformation is described in Belgian Patent No. 861.243 of the present applicant and has the advantage that such core is far less sensitive to rupture than a core used in the normal way that is not provided with deformations.

In a very advantageous embodiment of the strand according to the invention, the core wire is or the core wires constituting the core are made of a carbon steel with a tensile strength smaller than 2250–1130 log d N/mm$^2$, d being the wire diameter in mm. Such core with a lower tensile strength than indicated hereinabove with respect to the outside wires has a reduced rupture risk. The breaking elongation of such core wires with lower tensile strength is greater than the breaking elongation of a wire with higher tensile strength. If the core wires applied have a tensile strength smaller than 2250–1130 log d N/mm$^2$ and have, moreover, received an undulatory deformation in longitudinal direction, as indicated hereinbefore, a strand is obtained the core of which will remain intact even under very extreme load an bending, having a very favourable effect upon the operational life of the strand.

The core wire or the core wires constituting the core can also be suitably made of carbon steel with a tensile strength of at least 2250–1130 log d N/mm$^2$, preferably at least 2325–1130 log d N/mm$^2$, d being the wire diameter. Such type of strand is important when extremely high tensile loads are applied to the strand, while the bending loads are kept lower.

For certain applications, the strand core does not have to be made of carbon steel wire. For applications in which the core is subjected to strongly varying bending loads it may be advantageous that the core wire or the core wires constituting the core consist of a synthetic monofilament.

In that case, the type of synthetic material chosen will suitably have a good deformation resistance, so that the polymer penetration between the outside wires is always maintained. Synthetic materials applicable for the monofilaments are for instance: polymide, polyester and, in particular, paraphenylene terepthalic amide.

The invention also relates to objects of polymer material, these objects being reinforced with one or more strands according to the invention.

The invention particularly relates to a rubber vehicle tire comprising a carcass and at least one belt, reinforced with strands of carbon steel wire. Such rubber tire is characterised according to the invention in that the carcass and/or the belt are reinforced with strands according to the invention. Such strand to be used for the carcass and/or the belt can for instance be composed of one core wire and four outside wires arranged round it. Assuming that the outside wires have a diameter of for instance 0.25 mm, calculations show that, if the four outside wires are applied with the highest packing density, a wire with a diameter of 0.10 mm will fit the hollow space which remains free inside the outside wires. A core wire with a diameter of 0.15 mm will then be chosen, for instance, to obtain the required rubber penetration. If all wires were made of carbon steel that has not been drawn to high tensile strength (in other words, wires with a tensile strength of not more than 2250–1130 log d N/mm$^2$, d being the wire diameter in mm), the strength required for the strand would be attained with a strand composed of a core wire of 0.15 mm and four outside wires of 0.25 mm arranged round it. If the outside wires are made of carbon steel that is drawn to high tensile strength (in other words, with a tensile strength of at least 2250–1130 log d N/mm$^2$, preferably 2325–1130 log d N/mm$^2$), the diameter of the outside wires can be reduced from 0.25 to 0.23 mm for a strand with equal strength. By this reduction in the diameter of the outside wires, the core wire diameter being equal, a considerable increase in rubber penetration is attained with the same strand strength. If desired for certain purposes, the core wire can also be constituted by a core wire of carbon steel that is drawn to high tensile strength, or, alternatively, by a core wire consisting of a synthetic monofilament.

In order to attain optimal properties, the core wire has further received a regular undulatory deformation in longitudinal direction as described hereinbefore.

Dependent on the purpose of the strands, a choice will be made with respect to the wire diameters to be used.

For passenger car tires, for instance, a core wire of 0.12 mm and 0.20 mm dia outside wires arranged round it will be most satisfactory for the formation of the tire carcass.

For the belt or belts present in the tire, a wire of 0.138 or 0.15 mm can be applied advantageously as core wire and wires of 0.23 or 0.25 mm as outside wires. The material of the core wire and of the outside wires can be chosen within the scope of the invention as indicated hereinbefore.

For application in truck tires, when strands are used for the carcass, it will be possible to use same strands indicated hereinbefore for the passenger car tires, too. An excellent result will be obtained for the belt if a diameter is chosen of from 0.18 up to 0.21 mm for the core wires and of from 0.30 up to 0.35 mm for the outside wires; the types of material again being chosen from the types according to the invention described hereinbefore.

The numerical values indicated hereinbefore are solely meant as example and do not restrict the invention in any way.

Figure 1B:
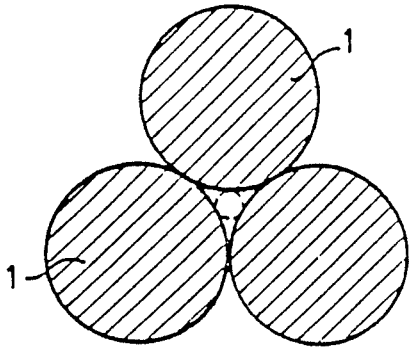
Figure 2A:
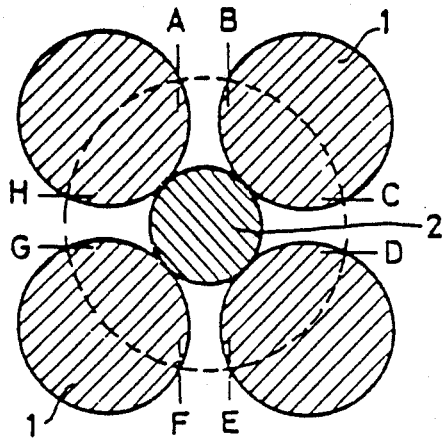
Figure 2B:
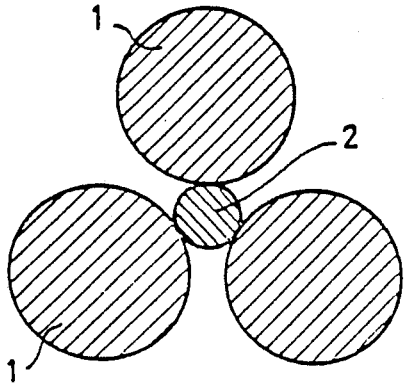

The invention will hereinafter be illustrated with the help of the accompanying drawing, wherein:

FIGS. 1*a* and 1*b* represent a couple of outside wire arrangements with the highest packing density and FIGS. 2*a* and 2*b* represent the outside wires from FIGS. 1*a* and 1*b* after the application of a core wire.

Figure 3:
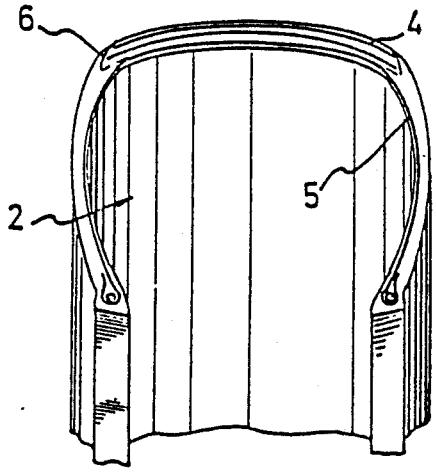

FIG. 3 is a partial section of a representative reinforced pneumatic tire according to the present invention.

FIG. 1*a* represents four outside wires 1 with the highest packing density. A dotted line indicates the tangent circle in the hollow space left free by the four wires 1, which each time corresponds to the minimum value of the core wire 2 to be applied for these outside wires. In FIG. 1*b* such highest packing density of outside wires is indicated for application of three outside wires 1. Here again, a dotted line indicates the circle diameter of which corresponds to the minimum value of the diameter of the core wire 2 to be applied for this arrangement.

FIG. 2*a* represents the outside wires of FIG. 1*a* in a configuration wherein the core wire 2 is surrounded by the outside wires 1. Giving the core wire 2 a diameter larger than the minimum diameter represented in FIG. 1*a* provides an enhanced penetration capacity for the polymer material between the outside wires 1.

FIG. 2*b* the same situation for a strand consisting of one core wire 2 and three outside wires 1 as in the original from sketched in FIG. 1*b*.

Referring to FIG. 3, three is shown a representative pneumatic tire 12, as contemplated by the present invention, having at least one layer of reinforcing elements 4, as described hereinbefore, a breaker or belt 6 and a carcass 5.

Here follow some specific values of a strand according to the invention ($1\times0.15+4\times0.23$) and of a state-of-the-art ($1\times0.15+4\times0.25$); the total tensile strength of both strands being nearly equal:

| Strand | Tensile strength (Newton) | Diameter (mm) | Openness (%) |
|---|---|---|---|
| acc. to invention | 571 N | 0.61 mm | 17.23 |
| acc. to state of the art | 570 N | 0.65 mm | 14.04 |

To determine the openness (%) of a strand, a circle is drawn centred on the centre of the core and passing through the centres of the outside wires (see FIG. 2*a*). The openness is the proportion of the sum of the lengths (AB; CD; EF; GH) between the outside wires to the total circumference of the circle.

I claim:

1. A reinforced object comprising polymer material and reinforcing strands, at least are of said reinforcing strands having a core comprising one carbon steel wire and at least three but less than six outside wires arranged around the core wire, the core wire having an outside diameter larger than the diameter of a circle tangent to each of the outside wires in a hollow space that ramains free when the cross-sections of said outside wires have the highest possible packing density and smaller than the diameter of the outside wires, wherein the outside wires are made of carbon steel wire with a tensile strength of at least 2250–1130 log d N/mm$^2$, d being the wire diameter in mm, said core wire having a tensile strength less than 2250–1130 log d N/mm$^2$.

2. The object according to claim 1 wherein the outside wires are made of carbon steel wire with a tensile strength of at least 2325–1130 log d N/mm$^2$, d being the wire diameter in mm.

3. The object according to claim 1 wherein the core has an undulatory deformation in the logitudinal direction.

4. The object of claim 1 wherein the reinforced object is a rubber vehicle tire reinforced with a plurality of said strands.

5. The object of claim 4 wherein only an associated carcass portion of said tire is reinforced with said strands.

6. The objects of claim 4 wherein only an associated belt portion of said tire is reinforced with said strands.

7. A rubber vehicle tire comprising a carcass and at least one belt reinforced with a plurality of strands at least one of said strands comprising a core having one carbon steel wire and at least three but less than six outside wires arranged around the core wire, the core wire having an outside diameter larger than the diameter of a circle tangent to each of the outside wires in a hollow space that remains free when the cross-sections of said outside wires have the highest possible packing density and smaller than the diameter of the outside wires, wherein the outside wires are made of carbon steel wire with a tensile strength of at least 2250–1130 log d N/mm$^2$, d being the wire diameter in mm, said core wire having a tensile strength less than 2250–1130 log d N/mm$^2$.

8. The tire according to claim 7 wherein the outside wires are made of carbon steel wire with a tensile strength of at least 2325–1130 log N/mm$^2$, d being the wire diameter in mm.

9. The tire according to claim 7 wherein the core has an undulatory deformation in the logitudinal direction.

10. A reinforced object comprising polymer material and reinforcing strands, at least one of said reinforcing strands having a carbon steel core comprising a strand composed of several carbon steel wires and at least three but less than six outside wires arranged around the core, the core having an outside diameter larger than the diameter of a circle tangent to each of the outside wires in a hollow space that remains free when the cross-sections of said outside wires have the highest possible packing density and smaller than the diameter of the outside wires, wherein the outside wires are made of carbon steel wire with a tensile strength of at least 2250–1130 log d N/mm$^2$, d being the wire diameter in mm, said core wires having a tensile strength less than 2250–1130 log d N/mm$^2$.

11. A reinforced object comprising polymer material and reinforcing strands, at least one of said reinforcing strands having a carbon steel core comprising at least one carbon steel wire and at least three but less than six outside wires arranged around the core, the core having an undulatory deformation in a longitudinal direction thereof and having an outside diameter larger than the diameter of a circle tangent to each of the outside wires in a hollow space that remains free when the cross-sections of said outside wires have the highest possible packing density and smaller than the diameter of the outside wires, wherein the outside wires are made of carbon steel wire with a tensile strength of at least 2250–1130 log d N/mm$^2$, d being the wire diameter in mm, said core wire having a tensile strength less than 2250–1130 log d N/mm$^2$.

12. A rubber vehicle tire comprising a carcass and at least one belt reinforced with a plurality of strands, at least one of said strands comprising a carbon steel core and at least three but less than six outside wires arranged around the core, the core comprising a core strand composed of several carbon steel wires, the core having an outside diameter larger than the diameter of a circle tangent to each of the outside wires in a hollow space that remains free when the cross-sections of said outside wires have the highest possible packing density and smaller than the diameter of the outside wires, wherein the outside wires are made of carbon steel wire with a tensile strength of at least 2250–1130 log d N/mm$^2$, d being the wire diameter in mm, said core wires having a tensile strength less than 2250–1130 log d N/mm$^2$.

13. A rubber vehicle tire comprising a carcass and at least one belt reinforced with a plurality of strands, at least one of said strands comprising a carbon steel core having at least one carbon steel wire and at least three but less than six outside wires arranged around the core, the core having an undulatory deformation in a longitudinal direction thereof and having an outside diameter larger than the diameter of a circle tangent to each of the outside wires in a hollow space that remains free, when the cross-sections of said outside wires have the highest possible packing density and smaller than the diameter of the outside wires, wherein the outside wires are made of carbon steel wire with a tensile strength of at least 2250–1130 log d N/mm$^2$, d being the wire diameter in mm, said core wire having a tensile strength less than 2250–1130 log d N/mm$^2$.

* * * * *

UNITED STATES PATENT AND TRADEMARK OFFICE

CERTIFICATE OF CORRECTION

PATENT NO. : 4,969,497

DATED : November 13, 1990

INVENTOR(S) : Luc BOURGOIS

It is certified that error appears in the above—identified patent and that said Letters Patent is hereby corrected as shown below:

Column 4, line 36, delete "three" and insert --there--.

Column 4, line 63, delete "are" and insert --one--.

Signed and Sealed this

Second Day of June, 1992

*Attest:*

DOUGLAS B. COMER

*Attesting Officer*

*Acting Commissioner of Patents and Trademarks*